United States Patent [19]

Sparer et al.

[11] Patent Number: 4,830,523

[45] Date of Patent: May 16, 1989

[54] COMPLIANT HEAD LOADING MECHANISM FOR THERMAL PRINTERS

[75] Inventors: Steven J. Sparer, Rochester; Stanley W. Stephenson, Spencerport, both of N.Y.

[73] Assignee: Eastman Kodak Company, Rochester, N.Y.

[21] Appl. No.: 93,927

[22] Filed: Sep. 8, 1987

[51] Int. Cl.[4] ..... B41J 3/20; B41J 5/18

[52] U.S. Cl. ..... 400/120; 400/161; 400/320; 400/356; 400/663

[58] Field of Search ..... 400/120, 174, 161.5, 400/355, 356, 352, 320, 160, 161, 663

[56] References Cited

U.S. PATENT DOCUMENTS

| | | | |
|---|---|---|---|
| 824,418 | 6/1906 | Tarnum | 400/356 X |
| 3,888,339 | 6/1975 | Nowak et al. | 400/161.5 X |
| 3,989,131 | 11/1976 | Knirsch et al. | 197/1 R |
| 4,300,844 | 11/1981 | Keil | 400/120 |
| 4,439,777 | 3/1984 | Aprato | 346/76 PH |
| 4,632,584 | 12/1986 | Becchi et al. | 400/356 |
| 4,665,407 | 5/1987 | Hattori et al. | 400/356 X |

FOREIGN PATENT DOCUMENTS

| | | | |
|---|---|---|---|
| 186941 | 11/1906 | Fed. Rep. of Germany | 400/356 |
| 134217 | 2/1979 | Fed. Rep. of Germany | 400/161.5 |
| 5971 | 1/1986 | Japan | 400/663 |
| 20786 | 1/1986 | Japan | 400/356 |
| 63457 | 4/1986 | Japan | 400/356 |
| 125871 | 6/1986 | Japan | 400/356 |
| 127372 | 6/1986 | Japan | 400/356 |

OTHER PUBLICATIONS

IBM Tech. Disc. Bulletin, "Coil Actuated Dual Detent", Lockhart, vol. 19, No. 9, Feb. 1977, p. 3462.

*Primary Examiner*—Edgar S. Burr
*Assistant Examiner*—James R. McDaniel
*Attorney, Agent, or Firm*—Raymond L. Owens

[57] ABSTRACT

A compliant head loading mechanism for a thermal printer is disclosed which compliantly loads a thermal print head against a carrier and a receiver mounted on a drum to uniformly apply pressure across the receiver at the nip. The mechanism includes a spring biased pivotably mounted pivot bracket which is moved between load and unload positions and a bracket member which is pivotably mounted on the pivot bracket and which carries the print head.

2 Claims, 4 Drawing Sheets

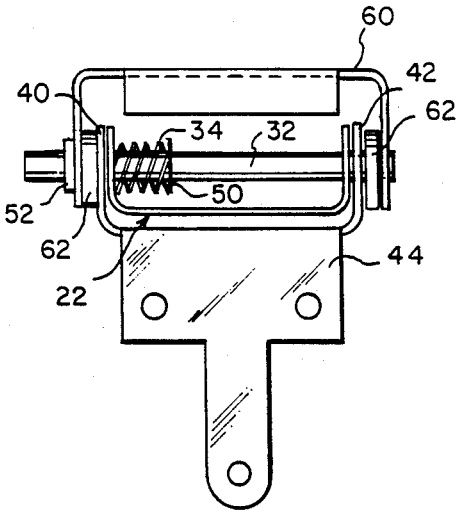
FIG. 2a
FIG. 2b
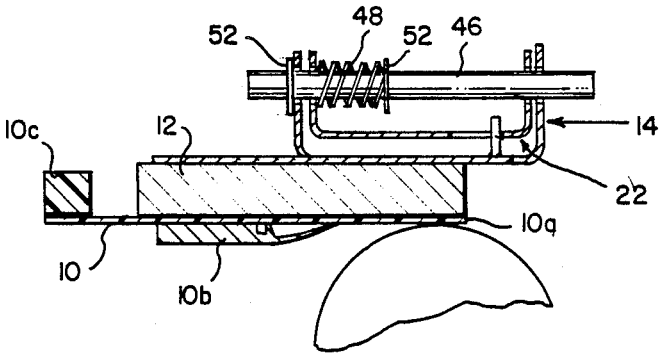

COMPLIANT HEAD LOADING MECHANISM FOR THERMAL PRINTERS

CROSS-REFERENCE TO RELATED APPLICATION

Reference is made to commonly assigned U.S. patent application Ser. No. 013,989 filed Feb. 17, 1987 to Spath.

FIELD OF THE INVENTION

The present invention relates to head loading mechanisms for thermal printers.

BACKGROUND OF THE INVENTION

In a typical thermal printer, a web-type carrier containing a repeating series of spaced frames of different colored heat transferable dyes is spooled on a carrier supply spool. The carrier is paid out from the supply spool and rewound on a take-up spool. The carrier moves through a nip formed between a thermal print head and a dye-absorbing receiver. The receiver is in turn supported by a platen in the form of a drum. The print head engages the dye carrier and presses it against the receiver. The receiver may, for example, be coated paper and the print head is formed of, a plurality of heating elements. When a particular heating element is energized, it produces heat. In the presence of heat and pressure, dye from the carrier is caused to transfer to the receiver. The density or darkness of the printed color dye is a function of the energy delivered from the heating element to the carrier. These types of thermal printers offer the advantages of "true continuous tone" dye density transfer. This result is obtained by varying the energy applied to each heating element, yielding a variable dye density image pixel on the receiver.

The web-type carrier often includes a repeating series of yellow, magenta and cyan dye frames. The carrier is typically formed of a very thin, flexible dye carrying member having a thickness that can be on the order of ¼ mil. At the beginning of the print cycle, the head must be lifted off the drum to allow a receiver sheet to be wrapped about the drum and advanced under the print head. This pre-printing process requires that the drum turn without the head or carrier being in contact with the drum. To begin printing, the first dye frame, typically yellow, is advanced to a position under the print head. The print head is lowered by a head loading mechanism to apply pressure on the carrier-receiver (media) as the drum turns. The media slides under the print head and the heating elements are selectively energized to form a row of yellow image pixels under the print head. The drum turns to generate successive rows of the yellow pixels of the final image. When the yellow image has been deposited, the head is lifted and the receiver is repositioned for the next color frame of the carrier. During such repositioning, the carrier is moved so that the next dye frame, for example magenta, is positioned under the print head. When the printer is ready for the second dye frame, the head is lowered to re-establish contact with the media, and the next color image is deposited on top of the previous color image in the receiver. The process is repeated for the final color, in this case the cyan dye frame. The three dyes are blended during the deposition process to generate a full-color image. After the three colors of the full-color image have been deposited, the printing process is completed. The head must be lifted again to allow the drum to turn and eject the receiver. The print head must continue to be held up for the next receiver sheet.

The process of applying the print head to the drum must be done in a manner that allows the head to be positioned accurately, repeatedly, and with uniform pressure across the drum to provide a high-quality print. The thermal head linear array of heating elements should be positioned tangent to the drum and centered radially over the drum surface. In addition, the heating elements should be pressed against the platen surface with uniform force across the receiver surface. Because manufactured parts vary from perfect dimensions, a head loading mechanism should be designed to minimize the effect of these dimensional errors on print quality. If this accuracy cannot be built into the head loading mechanism, adjustments must be built in. Such adjustments add to the complexity and expense of the mechanism. The repeatability of the mechanism is guaranteed if the print head returns to the same position after a lift-and-lower cycle. If the print head does not return to the same position for each of the dye frames, the resolution of the image will be degraded.

SUMMARY OF THE INVENTION

According, it is an object of the invention to provide an improved thermal print head loading mechanism which accurately positions the print head.

This object is achieved in a thermal printer by a mechanism which compliantly loads a thermal print head against a dye carrier and a receiver mounted on a rotatable drum to form a nip. Such mechanism includes (a) a cam which rotates in synchronism with said drum; (b) a pivot bracket pivotably mounted at one end and including a cam follower at its opposite end; (c) latching means which is effective in a first latched condition to latch the said pivot bracket in a raised position such that it is prevented from lowering to a loaded position and in a second unlatched condition to permit said pivot bracket to move to such loaded position; d) resilient means coupled to the pivot bracket to urge said cam follower into operative relation with said cam which moves said pivot bracket between its raised and loaded positions; and e) a bracket member pivotably mounted on said pivot bracket, said head being fixed to said bracket member so that as said drum rotates and said pivot bracket is moved to its loaded position, said print head is constrained from moving in any direction other than to compliantly load the carrier and receiver against the rotating drum with uniform force across the receiver at the nip.

Some advantages of this mechanism are: the accurate placement of a thermal print head on the media during the printing cycle, and the ability to pivot the thermal print head away from the media and drum allowing access to service or replace some internal components of the printer.

BRIEF DESCRIPTION OF THE DRAWINGS

FIGS. 2*a* and 2*b* show sectional views on the taken along the lines A—A and B—B respectively of FIG. 1;

Referring first to FIG. 1, the major components of a compliant head loading mechanism 9 are shown in an exploded view. Mechanism 9 is mounted in a thermal printer. A thermal print head 10 is fixedly mounted by glue or some other fastening means to a thermal head mounting plate 12. A bracket member 14 is aligned to the plate by pins 16 (only two of which are shown). The bracket member 14 has four tabs, 14*a*, 14*b*, 14*c*, and 14*d*, which are folded into an up position. Tabs 14*a* and 14*b* have co-axial holes 15 formed in them. Tabs 14*c* and 14*d* extend through slots 18 and 20 formed a channel shaped pivot bracket 22 The side walls of the pivot bracket 22 have a cylindrically shaped holes 24 and 26 and slotted holes 27 and 28. Also, pivot bracket 22 has a threaded hole to fixedly mount a cam follower member 30. A pin 32 with an associated spring 34 passes through co-axial cylindrical holes 36 and 38 formed in spaced arms 40 and 42 respectively of a post member 44 and pivotably mounts the pivot bracket 22 on the post member 44. Post member 44 is fixedly secured by screws (not shown) to the chassis of the thermal printer. See FIG. 2*a*. A pin 46 passes through holes 24 and 26 in the side walls of pivot bracket 22 and holes 15 in tabs 14*a* and 14*b* of bracket member 14. A spring 48 cooperates with the pin 46 in a manner described later. This arrangement pivotably mounts the bracket member 14 on the pivot bracket 22. See FIG. 2*b*. FIG. 5 is an isometric of the mechanism 10 as assembled in a thermal printer. Sections of FIG. 1 are shown in FIGS. 2*a* and 2*b* respectively.

FIG. 2*a* show how the pivot bracket 22 is pivotably mounted on the pin 32. In FIG. 2*a*, one end of the pin 32 is fixed to a cover member 60, only a small portion of which is shown. Spacers 62 are also mounted on the pin 32 to align the assembled elements. By means of this arrangement, the pivot bracket 22 is pivotably mounted at one end and has its cam follower 30 at its opposite end. The compression spring 34 bears against a retaining ring 50 and a wall of pivot bracket 22. In FIG. 2*b*, we see the bracket member 14, and the thermal print head 10 (in more detail). Head 10 includes a ceramic portion 10*a* having heating elements at the point of contact (e.g. the nip), protective shield 10*b* and a socket 10*c* for drive electronics for the heating elements. The compression spring 48 bears against a retaining ring 52 and the side wall of pivot bracket 22. Causing tabs 14*c* and 14*d* on bracket 14 to register and locate against slotted holes 18 and 20 on backet 22.

CAM LIFT OPERATION

Figure 3A:
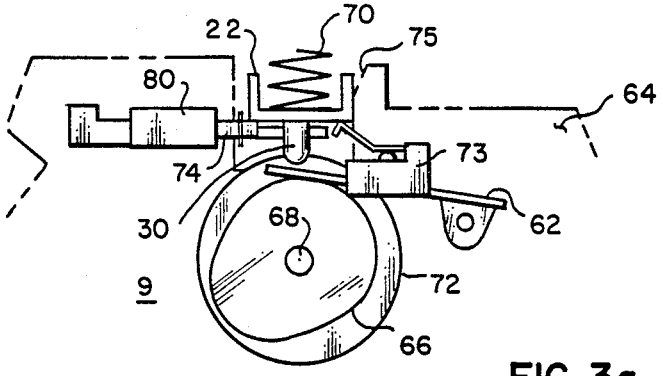
FIGS. 3*a*, 3*b*, and 3*c* are schematics showing part of the compliant head loading mechanism in three operating positions as viewed from the side.
Figure 3B:
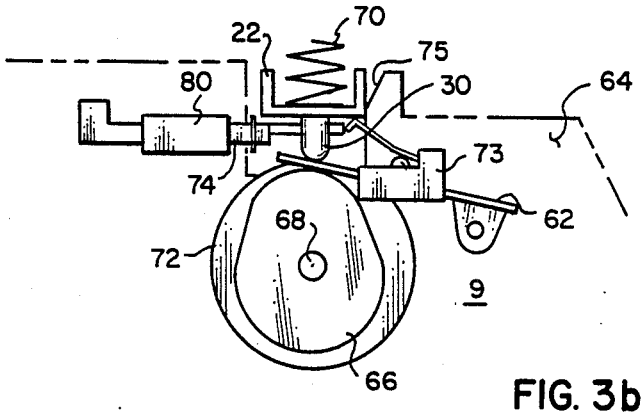
Figure 3C:
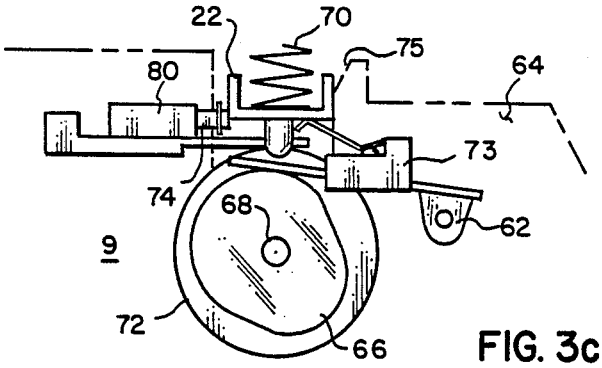
Figure 5:
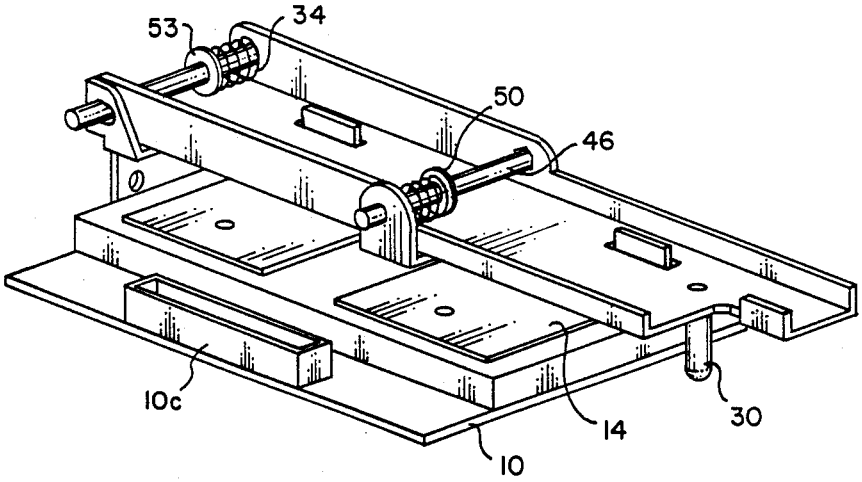
FIG. 5 is an isometric showing the mechanism of FIG. 1 in an assembled condition with certain parts not shown to facilitate understanding.
Figure 4:
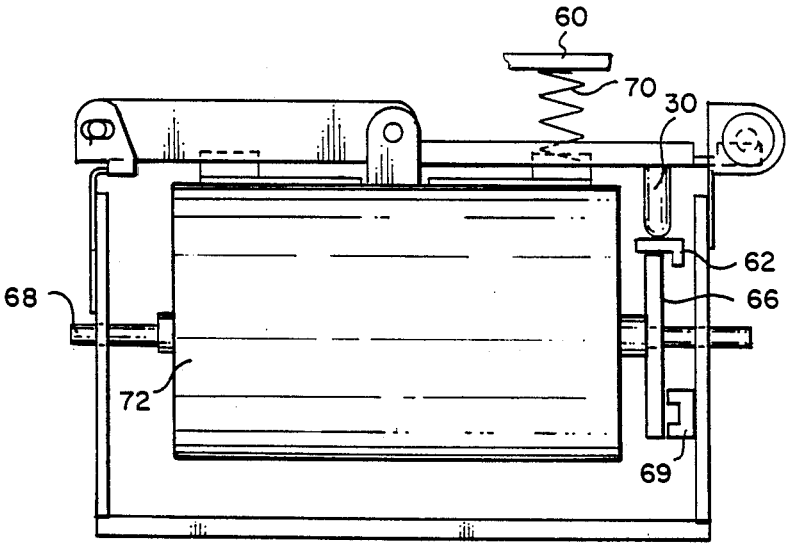
FIG. 4 shows parts of the mechanism of FIG. 1 in an assembled fashion.

Referring now to FIGS. 3*a*, 3*b*, and 3*c*. FIG. 3*a* shows the pivot bracket 22 is its latched position. FIG. 3*b* shows the pivot bracket 22 in it raised position, and FIG. 3*c* shows the pivot bracket 22 in its loaded position. Only certain parts are shown for simplicity. In FIG. 3*a* the mechanism 9 is (shown) at rest in the latched position after completion of a printing cycle. This position is determined when a molded blade extension formed on cam 66 and extending radially out from its center crosses the optical path of a sensor 69 (see FIG. 5). Sensor 69 is rigidly mounted on the printer chassis. The urging action of spring 70 causes the thermal head pivot bracket 22 to be forceably loaded on the solenoid plunger 74 of a solenoid assembly 80. Feedback from switch 73 confirms proper orientation of pivot bracket 22. With a space maintained between thermal head 10 and drum 72, the web type carrier can be transported without obstruction to position a particular dye colored frame under the thermal print head 10.

The print cycle begins by rotating drum 72 in a clockwise direction. Signals from a microcomputer (not shown) control the operation of a drive motor which engages shaft 68 and attached drum 72 and cam 66 to rotate them in a clockwise direction. As drum shaft 68 rotates, lifting lever 62 which continuously sides on the surface of cam 66, is moved upward against the urging force of spring 70 by the rise profile of cam 66 until it engages follower pin 30. Further rotation of shaft 68 moves pivot bracket 22 along with its component parts upward to its maximum raised position shown in FIG. 3b. Since the lifting lever 62 is pivoted on one end at a position lower than its contact point with cam 66, the lever 62 drives the pivot bracket 22 upward against a locating surface 75 formed on the printer chassis 64. Electronic signals delivered to the drum drive system along the feedback from sensor 69 and a switch 73 assure the thermal head positioning bracket 22 is in the lifted position. The switch 73 is operated by the pivot bracket 22. The pivot bracket 22 is then moved downward until it is at its loaded position. At this position, the follower 30 is spaced from the lifting lever 62. See FIG. 3c.

In one embodiment, the cam 66 and lifting lever 62 actually lifted the pivot bracket 22 in its raised position, one sixteenth of an inch past the solenoid plunger. Since the position of the drum is known from its "home" position by the microcomputer, the solenoid 80 is energized with out the force of spring 70 acting on the plunger 74. During this point of rotation as the pivot bracket 22 moves to its loaded position, the fall profile on cam 66 allows lifting lever 62 to move away from the follower pin 30. This permits the thermal head 10 to be uniformly loaded across the drum surface at the nip by the urging force of spring 70. Its at this point in the printing cycle that the thermal head 10 compresses the dye frame and receiver to the drum 72 allowing sublimation dye transfer to take place.

The raising and lowering movement of the pivot bracket 22 is repeated for each of the three dye frames required to make a continuous color print. To eject the finished receiver out of the printer, the cam 68 continues to rotate in the clockwise (printing) direction permitting the solenoid plunger 74 to move under the pivot bracket 22 preventing it from lowering. This latched position is shown in FIG. 3*a*. The drum 72 and cam 66 continue to rotate until the trailing edge of the receiver enters an exit chute (not shown) inside the printer chassis. Once in the chute the drum 72 reverses direction to a counterclockwise rotation ejecting and unclamping the receiver. The drum 72 reverses direction back to a clockwise rotation and returns to the home position identified by the sensor crossing described before.

COMPLIANT LOAD AND POSITIONING OPERATION

Figure 1:
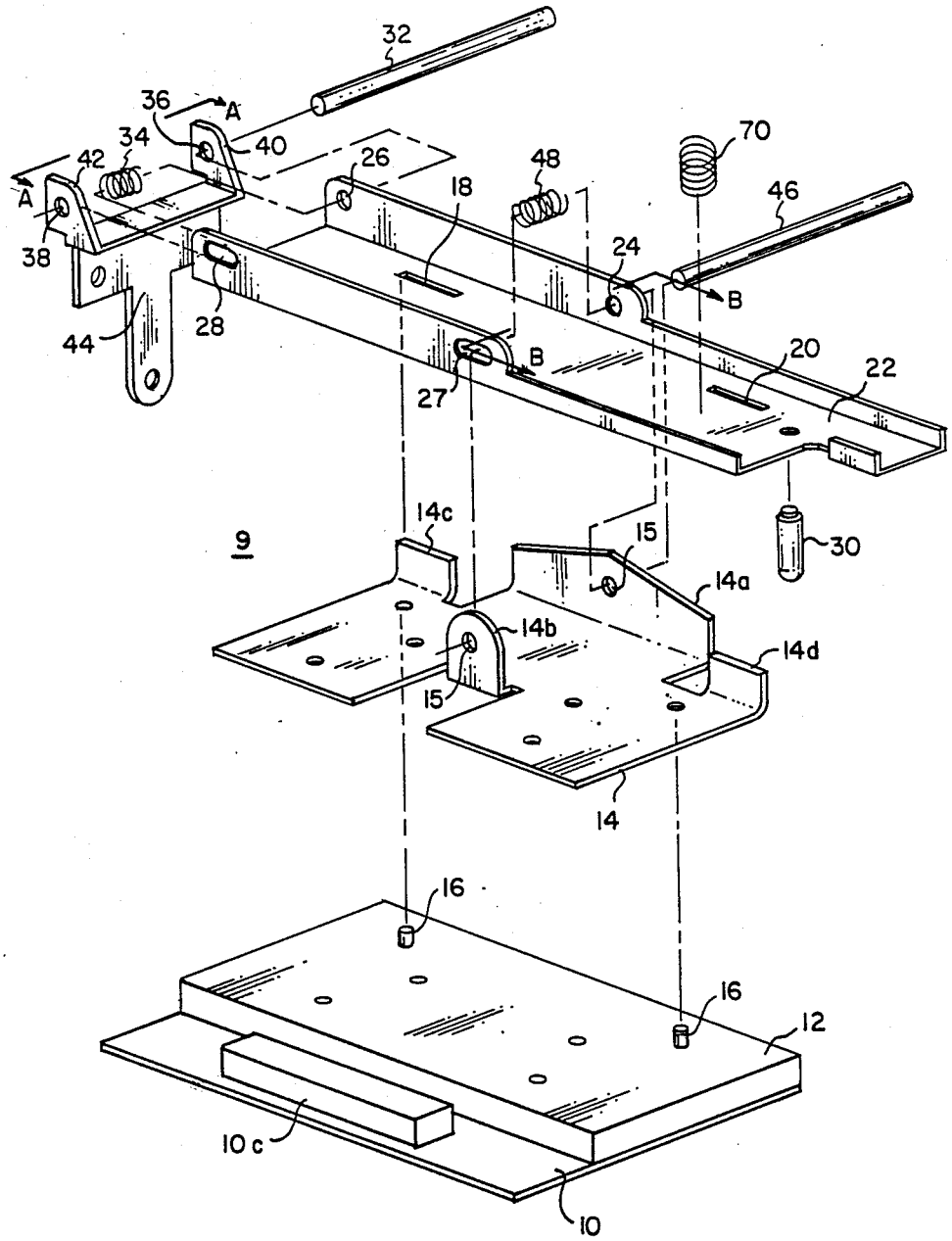
FIG. 1 is an exploded view of a compliant head loading mechanism for supporting and positioning a thermal print head with certain parts not shown to facilitate understanding.

In FIG. 1 and sectional view FIG. 2b, the bracket member 14 along with the print head 10 and the plate 12 are pivotably mounted and spring loaded on shaft 46 fastened to bracket 44. The slotted hole 27 in pivot bracket 22 allows the thermal head mounting bracket 14 to position itself such that tabs 14*c* and 14*d* rest against the forward edge of slotted holes 18 and 20. It is important to note that the bracket member 14 has close tolerance locating holes which accept the locating pins 16 of plate 12 to which the thermal head 10 is mounted. The locating pins 16 on plate 12, define the position of the line of heating elements of thermal head 10. The line of heating elements on the thermal head 10 is located with respect to the thermal head pivot bracket 22 and the media nip with a high degree of accuracy. The bracket member 14 with its component parts is fully constrained in all directions except for its ability to rotate about shaft 46. This allows the thermal print head 10 to apply uniform force across the receiver and dye frame at the nip on drum 72.

In similar fashion (as described above) the pivot bracket 22 is pivotably mounted on bracket 44 and loaded on shaft 32 by spring 34. Refer to FIGS. FIGS. 1 and 2*a*. As the bracket 22 is actuated up and down by the rotation of cam 66, it is held in contact against the locating surface 75 (FIG. 3*c*) of the printer chassis (described earlier). Clockwise rotation of drum 66 with applied head load from spring 70 during the printing cycle adds to the constraining of pivot bracket 22 against the post member pivot bracket 44 and surface 75.

The invention has been described in detail with particular reference to a certain preferred embodiment thereof, but it will be understood that variations and modifications can be effected within the spirit and scope of the invention.

We claim:

1. A compliant head loading mechanism for a thermal printer which compliantly loads a thermal print head against a dye carrier and a receiver mounted on a rotatable drum to form a nip comprising:

(a) a cam which rotates in synchronism with said drum;

(b) a pivot bracket pivotable mounted at one end including a cam follower at its opposite end;

(c) latching means which is effective in a first latched condition to latch said pivot bracket in a raised position such that it is prevented from lowering to a loaded position and in a second unlatched condition to permit said pivot bracket to move to such loaded position;

(d) resilient means coupled to said pivot bracket to urge said cam follower into operative relation with said cam which move said pivot bracket between its raised and loaded positions; and (e) means for pressing the thermal print head against the rotatable drum with a uniform force across the receiver surface including a bracket member pivotably mounted on said pivot bracket, said head being fixed to said bracket member so that as said drum rotates and said pivot bracket is moved to its loaded position, said head is constrained from moving in any direction other than to compliantly load the carrier and receiver against the rotating drum with uniform force across the receiver at the nip.

2. The invention as set forth in claim 1, wherein said latching means includes a solenoid plunger arrangement.

* * * * *